US007902529B2

(12) United States Patent
Quarmby et al.

(10) Patent No.: US 7,902,529 B2
(45) Date of Patent: Mar. 8, 2011

(54) METHOD AND APPARATUS FOR SELECTIVELY PROVIDING ELECTRONS IN AN ION SOURCE

(75) Inventors: Scott T. Quarmby, Round Rock, TX (US); George B. Guckenberger, Austin, TX (US)

(73) Assignee: Thermo Finnigan LLC, San Jose, CA (US)

( * ) Notice: Subject to any disclaimer, the term of this patent is extended or adjusted under 35 U.S.C. 154(b) by 253 days.

(21) Appl. No.: 11/833,215

(22) Filed: Aug. 2, 2007

(65) Prior Publication Data

US 2009/0032702 A1 Feb. 5, 2009

(51) Int. Cl.
*H01J 1/15* (2006.01)

(52) U.S. Cl. ..... 250/494.1; 250/423 R; 250/424; 250/427; 250/493.1; 250/281; 313/341; 313/343; 313/271; 313/272; 313/273

(58) Field of Classification Search ..... 250/281–300, 250/423 R, 424, 425, 427, 493.1, 494.1, 522.1; 313/341, 343, 271, 272, 273
See application file for complete search history.

(56) References Cited

U.S. PATENT DOCUMENTS 3,260,888 A * 7/1966 Webb, Jr. ..... 315/68
3,423,584 A 1/1969 Erickson
3,701,915 A 10/1972 Tsujimoto
3,739,118 A * 6/1973 Bounds ..... 200/61.45 R
3,919,579 A * 11/1975 Lemmers ..... 313/273
3,984,692 A * 10/1976 Arsenault ..... 250/423 R
4,105,916 A * 8/1978 Siegel ..... 250/282
4,661,710 A * 4/1987 Verney et al. ..... 250/423 R
4,684,206 A 8/1987 Bednorz et al.
4,878,866 A * 11/1989 Mori et al. ..... 445/36
5,256,947 A * 10/1993 Toy et al. ..... 315/111.81

(Continued)

FOREIGN PATENT DOCUMENTS

JP 2006024420 A * 1/2006

(Continued)

OTHER PUBLICATIONS

"GCMS-QP2010/2010s isolutions for GC/MS," Product Guide, Shimadzu Scientific Instruments, Inc., (20 pgs.), (2002).

(Continued)

*Primary Examiner* — Bernard E Souw
*Assistant Examiner* — Michael J Logie
(74) *Attorney, Agent, or Firm* — Haynes and Boone, LLP; David E. Allred; Michael C. Staggs

(57) ABSTRACT

An electron source can selectively provide a first stream of electrons that travels in a direction along an imaginary line to a location remote from the electron source, or a second stream of electrons that travels in the direction along the line to the location. The electron source includes a first electron emitter for selectively emitting electrons for the first stream, and a second electron emitter for selectively emitting electrons for the second stream. A different aspect relates to a method for operating an apparatus having an electron source that includes first and second electron emitters. The method includes selectively producing a first stream of electrons that travels from the first electron emitter in a direction along an imaginary line to a location remote from the electron source, or a second stream of electrons that travels from the second electron emitter in the direction along the line to the location.

24 Claims, 4 Drawing Sheets

U.S. PATENT DOCUMENTS 5,517,079 A * 5/1996 Seder et al. ..... 313/491
5,543,625 A 8/1996 Johnson et al.
5,563,410 A * 10/1996 Mullock ..... 250/288
5,600,136 A * 2/1997 Hablanian et al. ..... 250/288
5,850,084 A 12/1998 Holkeboer
5,973,329 A * 10/1999 Kim ..... 250/427
6,333,969 B1 * 12/2001 Kujirai ..... 378/138
6,356,026 B1 * 3/2002 Murto ..... 315/111.81
6,373,067 B1 4/2002 Shimomura
6,492,640 B2 * 12/2002 Terakura ..... 250/288
6,541,899 B1 * 4/2003 Haverlag et al. ..... 313/272
7,220,976 B2 * 5/2007 Joo ..... 250/492.21
7,323,682 B2 * 1/2008 McCauley et al. ..... 250/287
7,429,863 B2 * 9/2008 Carmichael et al. ..... 324/460
2004/0026628 A1 * 2/2004 Schweikhard et al. ... 250/423 R

FOREIGN PATENT DOCUMENTS

WO WO 2005/045877 A1 5/2005

OTHER PUBLICATIONS

Han et al., "Beam-type collisional activation of polypeptide cations that survive ion/ion electron transfer," Rapid Commun. Mass Spectrom., (vol. 21), (p. 1567-1573), (2007).

* cited by examiner

METHOD AND APPARATUS FOR SELECTIVELY PROVIDING ELECTRONS IN AN ION SOURCE

TECHNICAL FIELD

This invention relates in general to ion sources and, more particularly, to an ion source having an electron source configured to selectively provide electrons.

BACKGROUND

Existing mass spectrometers have an ion source that produces ions of a sample material. These ions are then processed by a mass analyzer which includes a mass detector. Some existing ion sources produce ions using a technique known as electron ionization (EI). Particles of a sample material that are referred to as analytes are supplied in a gas phase to an ion volume having a relatively low pressure, and a stream of electrons is also supplied to the ion volume. The electrons directly strike the sample analytes, and the resulting energy exchange is sufficient to cause ionization, producing ions characteristic of the sample material. These ions are then supplied to the mass analyzer.

A different type of ion source produces ions using a technique known as chemical ionization (CI). The analytes of the sample material are supplied in a gas phase to an ion volume, and a reagent gas such as methane is also supplied to the ion volume. Further, a stream of electrons is supplied to the ion volume. The ion volume is configured so that the inflow of the reagent gas maintains a relatively high pressure within the ion volume, thereby ensuring a density for the reagent gas that increases the probability of collisions between the incoming electrons and the molecules of the reagent gas. When electrons collide with the molecules of the reagent gas, the collisions produce ions of the reagent gas. The ions of the reagent gas then react with the analytes of the sample gas, in order to form further ions that are characteristic of the sample material. These further ions are then supplied to the mass analyzer.

In both EI and CI, an electron source is configured to selectively provide the stream of electrons to the ion volume. The electron source includes a filament that is energized to emit electrons for the stream. It is advantageous to provide a second filament. When one of the filaments burns out, an operator can continue running samples with the other filament. As such, the mass spectrometer is not rendered completely inoperative by a burned-out filament, and can continue operating with minimum disruption.

In one approach, two separate filaments are provided with one filament on each side of the ion volume. While this approach has been generally adequate for its intended purposes, it has not been entirely satisfactory in all respects. As one example, this approach increases the cost associated with manufacturing the mass spectrometer. Moreover, the design of this approach is more complex due to the electrical and mechanical connections that are required on both sides of the ion volume. In another approach, two separate filaments are supported on common structure that is positioned on one side of the ion volume. The two filaments are spaced from each other in a direction transverse to a direction of electron travel to the ion volume.

SUMMARY

One of the broader forms of the invention involves an apparatus that includes an electron source for selectively providing a first stream of electrons that travels in a direction along an imaginary line to a location that is remote from the electron source, and for selectively providing a second stream of electrons that travels in the direction along the line to the location, the electron source including: a first electron emitter for selectively emitting electrons for the first stream; and a second electron emitter for selectively emitting electrons for the second stream.

Another of the broader forms of the invention involves a method for operating an apparatus having an electron source that includes first and second electron emitters that can each selectively emit electrons, the method including: selectively producing a first stream of electrons that travels from the first electron emitter in a direction along an imaginary line to a location remote from the electron source; and selectively producing a second stream of electrons that travels from the second electron emitter in the direction along the line to the location.

DETAILED DESCRIPTION

Figure 1:
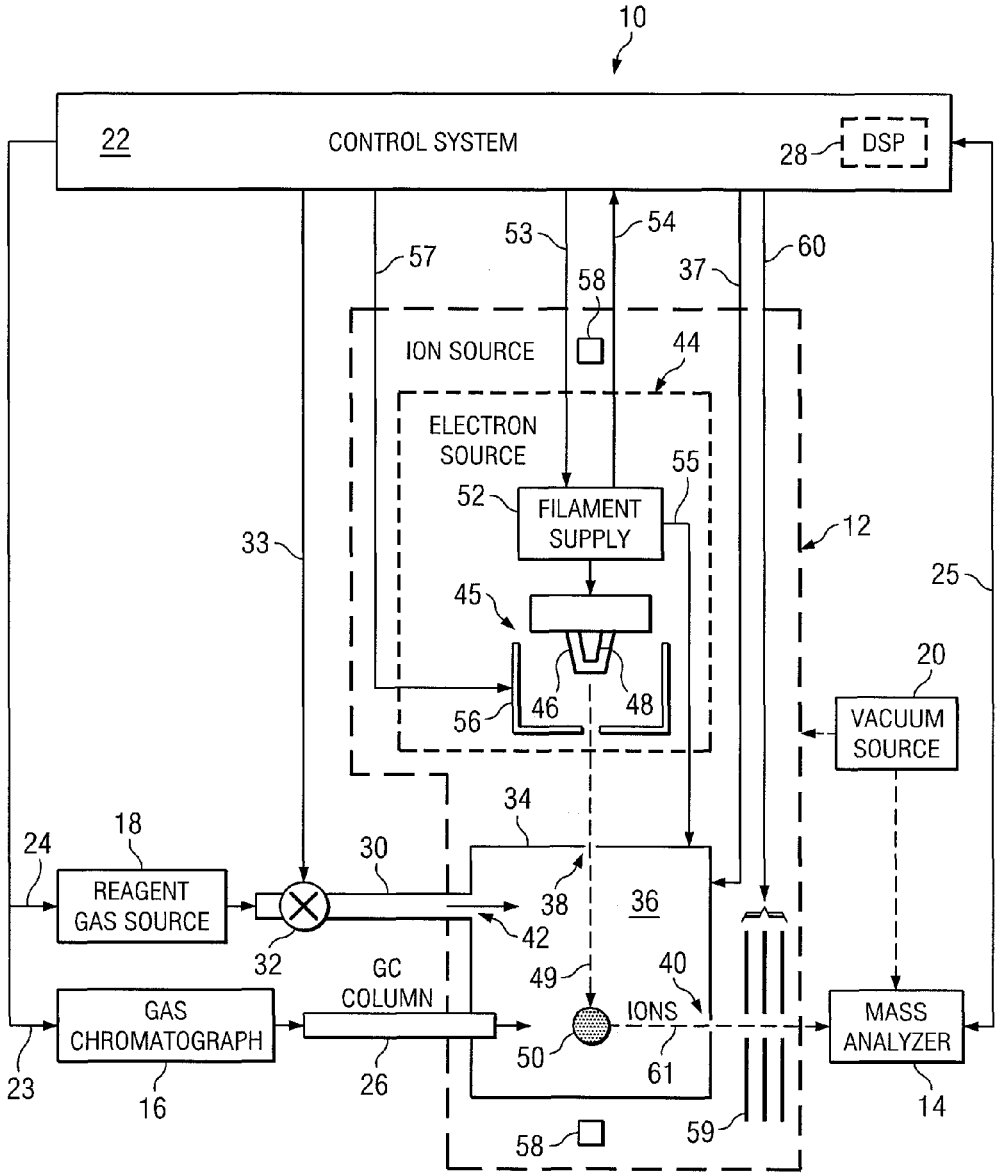
FIG. 1 is a block diagram of a mass spectrometer that embodies aspects of the present invention.

FIG. 1 is a block diagram of a mass spectrometer (MS) 10 that embodies aspects of the present invention. The mass spectrometer 10 includes an ion source 12, a mass analyzer 14, a gas chromatograph 16, a source 18 of a reagent gas, a vacuum source 20, and a control system 22. The disclosed mass spectrometer 10 is configured for chemical ionization (CI), but could alternatively be configured for electron ionization (EI).

The mass analyzer 14 is a type of device that is known in the art, and in fact could be any of a number of commercially-available devices. The mass analyzer 14 may include a not-illustrated device to separate ions based on their mass-to-charge ratios, examples of which include but are not limited to a quadrupole filter, a linear ion trap, a rectilinear ion trap, a three-dimensional ion trap, a cylindrical ion trap, a Fourier transform ion cyclotron resonance filter, an electrostatic ion trap, a Fourier transform electrostatic filter, a time-of-flight filter, a quadrupole time-of-flight filter, a hybrid analyzer, or a magnetic sector. Further, the mass analyzer 14 may include a not-illustrated detector that can detect ions. Since the mass analyzer 14 in FIG. 1 is a known type of device, it is not described here in further detail.

The gas chromatograph 16 is also a known type of device, and could be any of a number of commercially-available devices. The gas chromatograph 16 serves as a source of particles of a sample material that are referred to as analytes. In particular, the gas chromatograph 16 outputs analytes that are atoms or molecules of the sample material in a gas phase. The sample analytes delivered by the gas chromatograph 16 travel to the ion source 12 through a gas chromatograph (GC)

column 26 of a known type. For example, the GC column 26 may be a fused silica capillary tube of a type well known in the art. Alternatively, instead of the gas chromatograph 16 and GC column 26, the sample analytes may optionally be generated by a liquid chromatograph (LC) and delivered by an LC column.

The reagent gas source 18 is also a known type of device, and produces a flow of a reagent gas such as methane. The vacuum source 20 is a known type of system, and is operatively coupled to both the ion source 12 and the mass analyzer 14, in order to maintain a vacuum in interior regions during normal operation.

The control system 22 includes circuitry of a known type, and is operatively coupled to various other components of the mass spectrometer 10. In the disclosed embodiment, the control system 22 includes a digital signal processor (DSP) that is indicated diagrammatically at 28. The DSP 28 executes a software program that determines how the system 22 controls other components of the mass spectrometer 10. The DSP 28 could alternatively be a microcontroller, or some other form of digital processor. As another alternative, the DSP 28 could be replaced with a state machine or a hardwired circuit. The control system 22 includes an output 23 that controls the gas chromatograph 16 and an output 24 that controls the reagent gas source 18. The control system 22 further includes a line 25 that communicates with the mass analyzer 14 for transmitting and receiving data. In addition, the control system 22 includes other outputs that control various other components of the mass spectrometer 10, in a manner discussed later. It is to be understood that line 25 and the other lines to and from the controller may be provided by either a wired or a wireless transmission, or both.

The ion source 12 has therein an electrically conductive housing 34 with a chamber serving as an ion volume 36. The housing 34 has two openings 38 and 40 that provide communication between the ion volume 36 and the exterior of the housing. The opening 38 serves as an electron opening or an electron inlet port, and the opening 40 serves as an ion opening or an ion outlet port in a manner discussed herein. A gas supply conduit 30 extends from the reagent gas source 18 to the housing 34, and an electrically-operated valve 32 is provided along the conduit to control gas flow through the conduit. The valve 32 is controlled by an output 33 of the control system 22. The conduit 30 opens into the ion volume 36 through a gas inlet port 42. The end of the GC column 26 remote from the gas chromatograph 16 has an end portion that projects a short distance into the ion volume 36 through an opening in the housing 34.

The ion source 12 includes near the housing 34 an electron source 44. The electron source 44 includes a filament assembly 45 having two electron emitters, which may be of the thermionic emitter-type and take the form of filaments 46 and 48 having generally hairpin configurations that are positioned in relative overlying relationship to each other along an imaginary line 49 that extends through the electron inlet port 38 and into the ion volume 36. As shown in FIG. 1, (and more clearly in FIGS. 3 and 4 described below), the filaments may be disposed transverse to each other and have a hairpin configuration defining emission sections generally centered on the imaginary line 49. Alternatively, the filaments 46 and 48 may optionally include ribbon filaments, coil filaments, or combinations thereof. When energized, each filament 46 and 48 can emit a stream of electrons that propagates along the imaginary line 49 through the electron inlet port 38 to a target location 50, which may be a point or region within the ion volume 36. The electron source 44 includes a filament supply 52. The filament supply 52 can selectively energize either of the filaments 46 and 48. The filament supply 52 is controlled by an output 53 of the control system 22, so that the control system can selectively turn each of the filaments 46 and 48 on and off, in a manner discussed later. When energized, the filaments 46 and 48 are negatively biased with respect to the ion volume 36. The filament supply includes an output 55 coupled to the ion volume 36. The difference in potential between the ion volume 36 and the filaments 46 and 48 establishes the energy of the electrons as they travel to the ion volume. The filament supply 52 also includes an output 54 coupled to the control system 22 that indicates to the control system when either of the filaments 46 and 48 is burned out.

By way of further contradistinction with regard to past devices that include two filaments, the plural filament configurations of the embodiment of the present invention have less build up of insulative layers of neutral molecules. Insulative layers tend to build up less on an inactive filament of the embodiment of the present invention for at least two reasons. Firstly, the filaments are positioned close to each other. Therefore, heat from the active filament is transferred to the inactive filament such that condensation on the inactive filament is reduced. Secondly, the electrical potential on the inactive filament is substantially the same as or close to the electrical potential on the active filament. The small or non-existent electrical potential difference between the two filaments reduces the energy with which particles, such as electrons, impact the neutral molecules that have been adsorbed or condensed on the inactive filament. Less energetic impacts from the particles on the neutral molecules, which may include carbon or silicon for example, will tend away from decomposition of these neutral molecules into less volatile subcomponents such as carbon or $SiO_2$. Hence, reducing the potential difference between the filaments greatly reduces the likelihood that the neutral molecules will be impacted by high energy particles and remain on the inactive filament. Since fewer neutrals condense on the inactive filament because of heating of the inactive filament from the proximate active filament, there will be fewer neutrals on the inactive filament to be impacted in the first place. For these reasons, the insulative layer of material that would otherwise build up on the inactive filament is greatly reduced or eliminated.

The electron source 44 further may include an electron gate 56 of a known type. For example, an electron gate 56 may include one or more lens(es) that can be operated in one or more of a focusing or gating mode. The electron gate 56 may be provided between the filaments 46 and 48 and the electron inlet port 38, or may be omitted all together. When included, the electron gate 56 is controlled by an output 57 of the control system 22. The control system 22 can thus selectively and independently "open" and "close" the electron gate 56. When the electron gate 56 is open, the stream of electrons flowing along line 49 propagates through the gate and into the ion volume 36. On the other hand, when the electron gate 56 is closed, it interrupts the stream of electrons, so that the stream of electrons is inhibited from traveling to and entering the ion volume 36.

The ion source 12 includes a set of magnets 58 of a known type. The magnets 58 generate a magnetic field that is aligned parallel with the imaginary line 49 to help keep the stream of electrons collimated. The ion source 12 further includes a set of lens elements 59 of a known type. The lens elements 59 are disposed between the ion volume 36 and the mass analyzer 14. The lens elements 59 are controlled by one or more outputs 60 of the control system 22.

The ion volume 36 is used for chemical ionization (CI). The general principles of CI are known in the art, and are therefore described only briefly here, and not in detail. During operation, the valve 32 remains open to allow a continuous flow of the reagent gas to pass through the conduit 30 and into the ion volume 36. As shown diagrammatically in FIG. 1, the ion volume 36 has only a few very small openings including openings 38 and 40. Thus, due to these relatively small openings 38 and 40 and also the flow of reagent gas into the interior of the ion volume 36, the ion volume 36 is maintained at a relatively high pressure.

The gas chromatograph 16 contains a sample material, and produces analytes of the sample material such as atoms or molecules thereof, which are supplied through the GC column 26 in a gas phase to the ion volume 36. When the electron gate 56 is open and allows a stream of electrons to flow along line 49 to enter the ion volume 36, the electrons collide primarily with molecules of the high pressure reagent gas to form ions of the reagent gas. The relatively high pressure within the ion volume 36 ensures a density of the reagent gas that promotes such collisions in order to produce ions of the reagent gas. The ions of the reagent gas then react with the analytes of the sample gas in order to form ions characteristic of the individual analytes. Gas flowing out of the ion volume 36 through the ion outlet port 40 carries with it these ions.

The control system 22 applies an electrical potential to the ion volume 36 through the control line 37, and also applies at least one electrical potential to the lens elements 59. The potential between the ion volume 36 and lens elements 59 extracts and focuses the ions of sample material generated within the volume 36. In particular, the ions travel along a path 61 from the ion volume 36, through the outlet 40, and through the lens elements 59 to the mass analyzer 14. The path 61 of ions travel is approximately perpendicular to the stream of electrons flowing along the line 49. Even though the description above relates to a mass spectrometer operating by CI, the mass spectrometer 10 may alternatively be configured to operate by electron ionization (EI). In the case of EI, no reagent gas from source 18 is supplied to the ion volume 36, openings 38 and 40 may be made larger, and ions characteristic of the sample material are formed directly from interactions of the sample material with the electrons.

Figure 2:
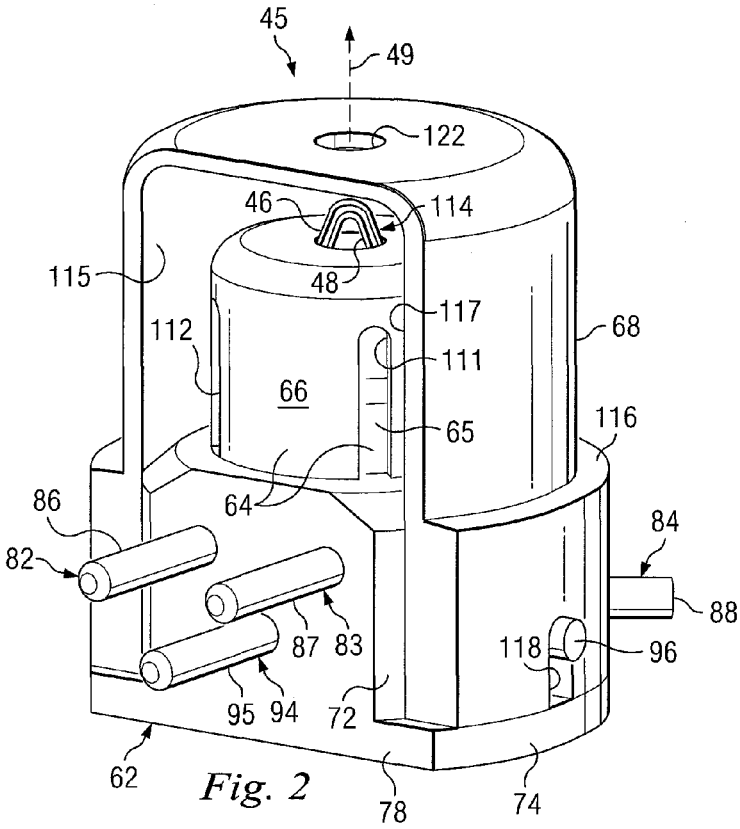
FIG. 2 is a diagrammatic perspective view of a filament assembly that is a component of the mass spectrometer of FIG. 1.
Figure 3:
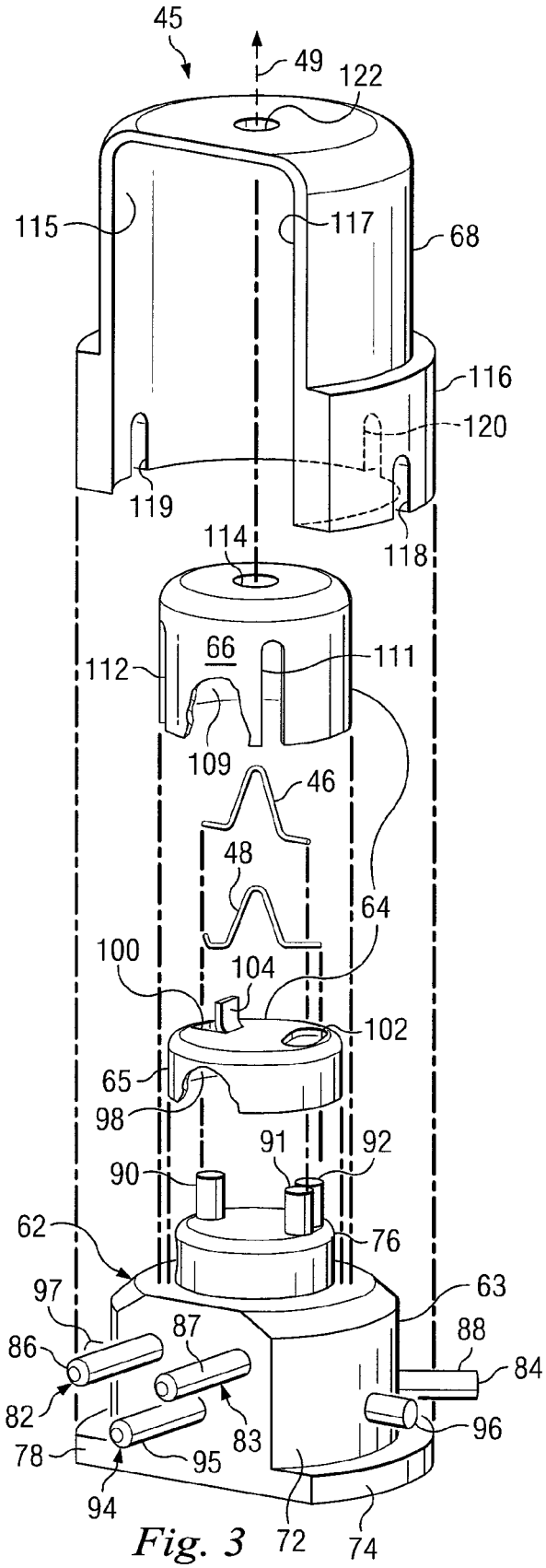
FIG. 3 is an exploded diagrammatic view of the filament assembly of FIG. 2.

FIG. 2 is a diagrammatic perspective view of the filament assembly 45 of FIG. 1, and FIG. 3 is an exploded diagrammatic view of the filament assembly. In FIGS. 2 and 3, the filament assembly 45 includes a base 62, a housing 64, an optional electron lens 68, and two filaments 46 and 48. All or part of the housing or some other electrical element in a region of the filaments 46 and 48 makes up a first portion of the ion source that can be electrically biased relative to the ion volume 36 in order to urge electrons toward the ion volume. The ion volume 36 may be in the form of an enclosure. All or part of the enclosure forming the ion volume, or some other electrical element proximate the target location 50 makes up a second portion of the ion source 12 that can be electrically biased relative to the filaments 46 and 48 in order to urge electrons toward the ion volume 36. It is to be understood that the electron lens 68 may provide all or part of the electron gate 56 described herein, and may be termed a third portion that can be electrically biased relative to both the filaments 46, 48 and the ion volume 36.

The base 62 includes an insulating body 63 that is formed of a ceramic material. In the disclosed embodiment, the body 63 is made of a ceramic material that is available commercially under the trade name MYCALEX from Crystex Composites LLC of Clifton, N.J. However, the body 63 could alternatively be made of any other suitable material that is an electrical insulator. The body 63 includes a mid portion 72, a bottom flange 74, and a top portion 76. The mid portion 72 has an approximately cylindrical shape with a flat surface 78 on one side. The bottom flange 74 projects radially outwardly and has an arcuate shape that surrounds the curved side of the mid portion 72. The top portion 76 has a cylindrical shape with a smaller diameter than the mid portion 72. The top portion 76 is positioned on the mid portion 72 such that the center axes of the mid portion and top portion are aligned.

The base 62 further includes three filament terminal posts 82-84 partially disposed within the body 63 and secured therein. The terminal posts 82-84 are L-shaped and made of stainless steel. Two of the terminal posts 82 and 83 have portions 86 and 87, respectively, extending horizontally outwardly through the flat surface 78 of the mid portion 72, and have portions 90 and 91, respectively, extending vertically upwardly through the top surface of a top portion 76. The third terminal post 84 has a portion 88 extending horizontally outwardly through the curved side of the mid portion 72, and a portion 92 extending vertically upwardly through the top surface of the top portion 76. Alternatively, the portion 88 of the third terminal post 84 may optionally extend horizontally outwardly through the flat surface 78 of the mid portion, with the portion 88 substantially parallel to the portions 86 and 87 of terminal posts 82 and 83, respectively.

The base 72 further includes a support post 94 disposed partially within the base. The support post 94 is made of stainless steel. The support post 94 is T-shaped with a portion 95 extending horizontally outwardly through the flat surface 78 of the mid portion 72 and two portions 96 and 97 extending horizontally outwardly through the curved side of the mid portion 72 at spaced locations.

The housing 64 includes a shield portion 65 that has a generally cylindrical shape. A shallow cylindrical recess 98 is formed by inner surfaces of the shield portion, as shown for illustrative purposes by a cut away portion in FIG. 3. The cylindrical recess 98 opens downwardly from an upper surface of the inner surfaces of the cylindrical recess 98. The shield portion 65 is made of stainless steel. The top of the shield portion 65 includes a vertical square opening 100 and a vertical oval opening 102 that each extend therethrough and communicate with the recess 98. The shield portion 65 also has an upward projection 104 disposed at an outer edge of the opening 100. The shield portion 65 is provided over and receives the top portion 76 of the base 62 within the recess 98. The opening 102 is sized to easily receive the portions 91 and 92 of the terminal posts 83 and 84 so that the edge of the opening 102 does not contact the portions 91 and 92. The opening 100 is sized to snugly receive the portion 90 of the terminal post 82, and the projection 104 is welded to the portion 90.

The housing 64 further includes a cover portion 66 that has a generally cylindrical shape with a cylindrical recess 109 formed by inner surfaces of the housing 64, as shown for illustrative purposes by a cut away portion in FIG. 3. The cylindrical recess 109 opens downwardly as shown in FIG. 3. The cover portion 66 is made of stainless steel. The cover portion 66 includes a plurality of vertical slots 111 and 112 that extend upwardly from a bottom edge of the cover portion 66 at circumferentially spaced locations. In FIG. 3, only two slots are visible. However, any number of equally spaced slots may be provided, for example. The top of the cover portion 66 includes a vertical opening 114 that extends therethrough and communicates with the recess 109. The imaginary line 49 extends centrally through the opening 114. The cover portion 66 is provided over and covers the shield portion 65, with the shield portion received snugly within the lower end of the recess 109. The cover portion 66 may be welded or otherwise fixed to the shield portion 65.

In the example of FIGS. 2 and 3, the electron lens 68 has a partially cylindrical shape with a partially cylindrical recess 115 that opens downwardly. The electron lens 68 is made of stainless steel. The electron lens 68 has an opening 117 on one side. The electron lens 68 includes a radially outwardly projecting bottom flange 116 with three vertical slots 118, 119, and 120 that extend upwardly from a bottom edge of the electron lens 68 at circumferentially spaced locations. The electron lens 68 may be placed over the base 62 with the flange 116 of the lens 68 being supported by the flange 74 of the base 62. The respective portions 86 and 87 of the terminal posts 82 and 83, and the portion 95 of the support post 94 that extend through the flat surface 78 of the mid portion 72 also extend through the rectangular opening of the lens 68. Two of the slots 118 and 119 are sized to snugly receive the portions 96 and 97 of the support post 94 that project outwardly from the mid portion 72 of the base 62. The electron lens 68 may be welded or otherwise fixed to the portions 96 and 97 of the support post 94.

The third slot 120 (shown by hidden lines in FIG. 3) is sized to easily receive the portion 88 of the terminal post 84 that projects outwardly from the curved side of the mid portion 72 so that an outer edge of the slot 120 does not contact the portion 88. The non-contacting fit avoids electrical contact between the terminal post 84 and the electron lens 68. The top of the electron lens 68 includes an opening 122 that is coaxially aligned with the opening 114 of the cover portion 66. Accordingly, the imaginary line 49 also extends centrally through the opening 122 of the electron lens 68. The electron lens 68 is positively biased with respect to the ion volume 36 (FIG. 1). In this regard, it is to be understood that all or part of the electron lens 68 may be considered an electrically conductive element that is in a region proximate to the filaments 46, 48. Alternatively, other elements having insulative or semiconductive properties may be capable of being biased and/or acting as an electron lens or gate for urging ions toward the ion volume 36.

The filaments 46 and 48 are both hairpin filaments that, as shown in FIG. 2, extend upwardly through the opening 114 of the cover portion 66. The filament 46 extends vertically upwardly through the opening 114 by a greater distance than the filament 48. It is to be understood that greater heat is retained in the filaments when they are disposed to a greater degree within the volume of the cover portion 66. However, the emission section of the filaments 46 and 48 will be shorter when the filaments 46 and 48 extend to a lesser degree through the opening 114 because of the geometry of the opening and a position of the portions of the filaments that are emitting electrons during operation. Also, when the filaments are deeper within the cover portion 66 users cause the filaments to get hotter in order to compensate for fewer electrons that will pass through the opening 114 of the cover. This can result in quicker burn out of filaments. Thus, there are a number of parameters and factors that can be adjusted with associated trade-offs. Nevertheless, the basic principles applied to the disclosed embodiment may be generally extended to other embodiments without departing from the spirit and scope of the invention.

Figure 4:
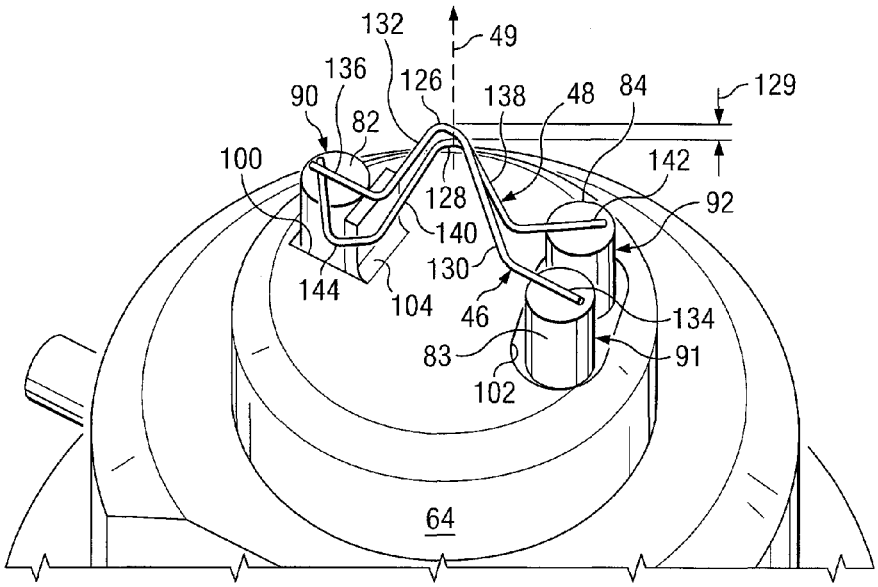
FIG. 4 is a diagrammatic fragmentary perspective view showing a portion of the filament assembly of FIG. 2 in an enlarged scale.

FIG. 4 is a diagrammatic fragmentary perspective view showing part of the filament assembly 45 of FIGS. 2 and 3 in an enlarged scale. Each filament 46 and 48 includes a small diameter refractory metal wire with a hairpin configuration. The diameter of the filaments may be approximately 0.004 in. (inch) although filaments having other diameters may be utilized. The filaments 46 and 48 have curved elongate emission sections 126 and 128, respectively, at their tips. The imaginary line 49 is normal to and extends through central axes of the emission sections 126 and 128, the emission sections 126 and 128 being vertically separated by a small distance 129, as measured from center to center of the filaments 46, 48. The distance 129 may be any value in a range from approximately 0.008 in. to approximately 0.2 in. from center to center of the filaments 46 and 48. As may be appreciated with 0.004 in. diameter filaments an actual spacing between outer diameters of the filaments will be approximately 0.004 in. at a lower end of this range. Examples of distances 129 within this range that may be applied include any value in a range from 0.010 to 0.015 in. from center to center of the filaments 46 and 48. When the filaments or their materials are somewhat flexible, the practical limit is that at which the filaments will not physically engage each other or otherwise act as a single filament. For example, a distance between the outer diameters of the filaments may be 0.002 in. in some cases.

The filament 46 has arms 130 and 132 extending downwardly at a diverging angle to each other from opposite sides of the emission section 126. The filament 46 has legs 134 and 136 horizontally extending from the lower end of each arm 130 and 132, respectively. The filament 48 has arms 138 and 140 extending downwardly at a diverging angle to each other from opposite sides of the emission section 128. The filament 48 has legs 142 and 144 horizontally extending from the lower end of each arm 138 and 140, respectively. The leg 144 of filament 48 is L-shaped.

The filaments 46 and 48 are welded to the terminal posts 82-84. More particularly, the legs 136 and 144 of the filaments 46 and 48 are both welded to the portion 90 of the terminal post 82. The second leg 134 of filament 46 is welded to the portion 91 of the terminal post 83. The second leg 142 of filament 48 is welded to the portion 92 of the terminal post 84. Accordingly, a current flowing through terminal posts 82 and 83 will energize filament 46 and a current flowing through terminal posts 82 and 84 will energize filament 48, in a manner discussed later. A first imaginary plane (not illustrated) includes the line 49 and a centerline of the filament 46, and a second imaginary plane (not illustrated) includes the line 49 and a centerline of the filament 48. These two imaginary planes are arranged at an angle with respect to each other. In the disclosed embodiment this angle is about 60°. However, the angle could alternatively be 90°. Further alternatively, the angle between these planes could be any of a variety of other angles including angles in a range from approximately 0° to approximately 90°.

Although the filaments 46 and 48 are shown as having a hairpin configuration and are operated as thermionic emitters commonly referred to as hot wire filaments, it is to be understood that other types of electron emitters could be substituted for the filaments 46 and/or 48 without departing from the spirit and scope of the invention. For example, electron emitters may be provided by field emitters, which may include electron discharge needles. Field emitters that include a plate with whiskers could be implemented if a very narrow tip is provided. The filaments 46 and 48 shown and described in the embodiment of this disclosure may be made of rhenium. Alternatively, the filaments 46 and 48 may optionally include tungsten, thoriated tungsten, thoriated tungsten rhenium, thoriated iridium, yttria coated rhenium, or any other suitable material. In addition, even though the filaments 46 and 48 are disclosed as hairpin filaments, it is understood that other types of filaments may optionally be used, such as ribbon filaments or coil filaments. As such, the filaments 46 and 48 may include combinations of different filament types, sizes/thicknesses, and/or different materials. For example, one filament may be a ribbon filament made of tungsten and the other filament may be a coil filament made of rhenium. A variety of combinations of filament types and materials are within the scope of this disclosure. The combinations of filament types and materials can be optimized for particular applications such as one or more of CI and EI, for example. Furthermore, it is to be understood that the term electron emitter as used herein may refer to more elements than the filaments or portions of the filaments that emit electrons. For example, the term electron emitter may refer to any number of elements that work together to emit electrons including one or more of a filament, any power source, a control for operating the power to the filaments, and any structural or operational elements supporting the filaments and their function.

Incorporation of different filament types may also require a different housing or other structure for supporting the filaments. For example, a platform like the shield described herein would be better adapted for supporting ribbon filaments. The relative positioning of the filaments may be described in terms of the spacing of the filaments or center lines of the filaments from the target location for the electrons. For example, the first filament may be spaced from the location by a first distance and the second filament may be spaced from the location by a second distance. The second distance may be greater than the first distance. On the other hand, with some filament types and geometries it is possible to make the distances from each of the filaments to the target location equal, such as by intertwining coil filaments for example.

Whereas the filaments 46, 48 are shown and described as hairpin type filaments positioned with a spacing between the emission sections, it is to be understood that the filaments 46, 48 could be replaced by coil filaments. Geometries of coil filaments may include two crossed coils, two coaxial coils of different diameters one inside the other, or two intertwined coils. As may be appreciated, by using different coil diameters, placing the coils in a coaxial relation, and/or intertwining the coils the emission sections may be located relative to each other as desired. In particular, the coils may be intertwined such that a distance from the emission section of each is at the same distance from the target location for the electrons. This can be achieved while keeping both filaments and their emission sections aligned with the electron entrance hole of the ionization volume.

Figure 5:
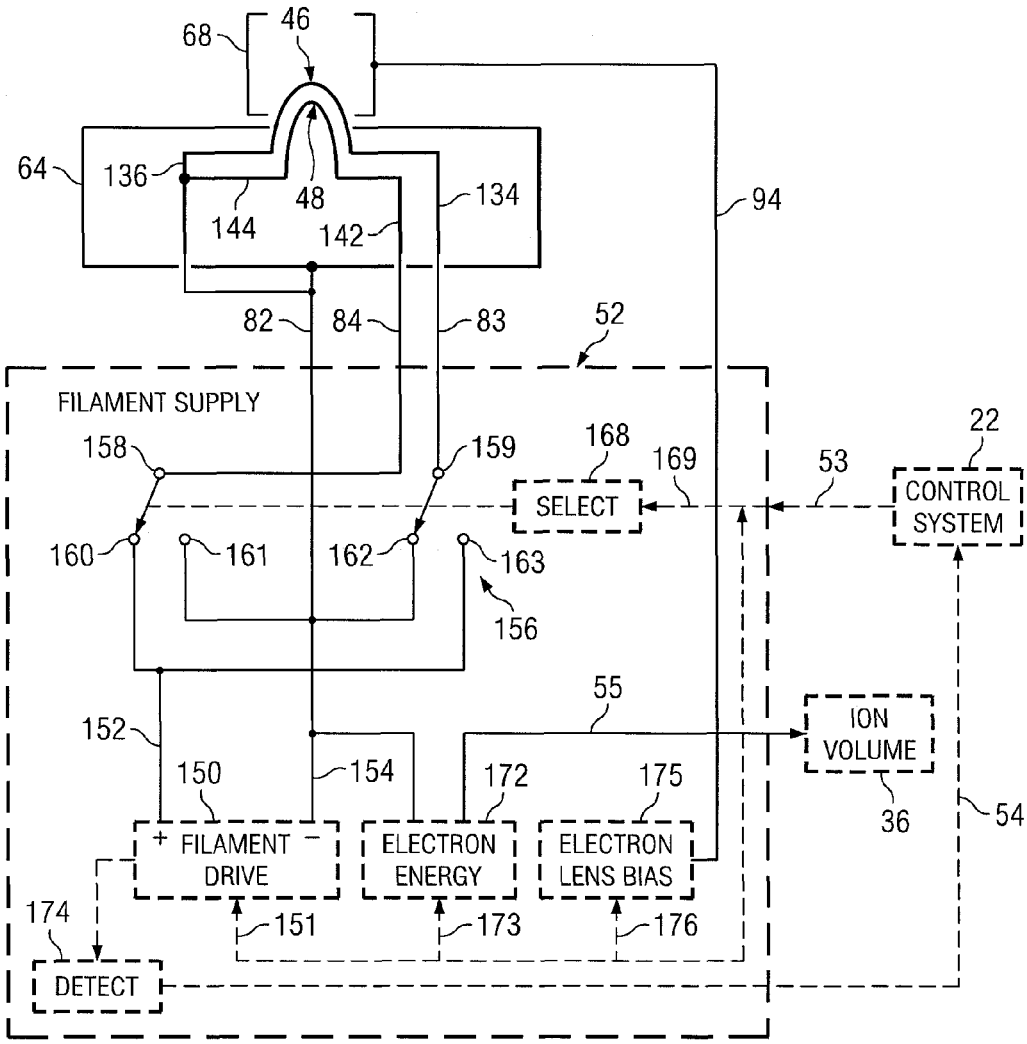
FIG. 5 is a schematic view of the circuitry of a filament supply that is a component of the mass spectrometer of FIG. 1.

FIG. 5 is a schematic diagram of the circuitry of the filament supply 52 of FIG. 1. The filament supply 52 is electrically coupled at 53 to the control system 22 for receiving control signals from the control system. The filament supply 52 includes a filament drive 150 that provides a current for energizing one of the filaments 46 and 48. The filament drive 150 is controlled by a control signal 151, and has a positive terminal 152 and negative terminal 154. The filament supply 52 includes a switch 156 that has six contacts 158-163 arranged in a double-pole double-throw configuration. Two contacts 160 and 163 are electrically coupled to the positive terminal 152 of the filament drive 150, and two contacts 161 and 162 are electrically coupled to the negative terminal 154 of the filament drive 150. The contact 158 is electrically coupled to filament terminal post 84 and the contact 159 is electrically coupled to filament terminal post 83. The third filament terminal post 82 is electrically coupled to the negative terminal 154 of the filament drive 150.

The switch 156 can be selectively switched between two states by a select circuit 168 that is controlled by a control signal 169 from the control system 22. The select circuit 168 may include a not-illustrated solenoid having a plunger coupled to the two movable switch contacts. The select circuit 168 can selectively energize either filament 46 or 48. The switch 156 is shown facilitating a current flow through filament 48 in one state. More particularly, the switch 156 is shown with contacts 158 and 160 closed and contacts 159 and 162 closed. As such, the filament drive 150 is operatively providing a current flow through terminal posts 82 and 84 and thus, filament 48 is energized by the filament drive. The inactive filament 46 is not energized or may be de-energized by connecting it to or holding it at the potential of the negative terminal 154 of the filament drive 150.

In the other state (not shown), the switch 156 operates with contacts 158 and 161 closed and contacts 159 and 163 closed. As such, the filament drive 150 is operatively providing a current flow through terminal posts 82 and 83 and thus, filament 46 is energized by the filament drive. The inactive filament 48 is not energized or may be de-energized by connecting it to or holding it at the potential of the negative terminal 154 of the filament drive 150. Energizing the filaments or electron emitters is for the purpose of producing the stream of electrons and may include causing a current flow through one of the electron emitters while preventing or inhibiting a current flow through the other of the electron emitters.

The negative terminal 154 of the filament drive 150 is electrically coupled to an electron energy circuit 172 that is controlled by a control signal 173 from the control system 22. The filaments 46 and 48 have their respective legs 136 and 144 electrically coupled to the negative terminal 154. The filaments 46 and 48 are electrically biased at a negative potential with respect to the potential of ion volume 36 so that emitted electrons are encouraged to travel to the ion volume. The difference in potential between the ion volume 36 and the filaments 46 and 48 establishes the energy of the electrons as they travel to the ion volume. The electron energy circuit 172 is electrically coupled to the ion volume 36 at output 55. In the disclosed embodiment, the ion volume 36 is grounded and filaments 46 and 48 are electrically biased at −70 V which generates electrons with an energy of 70 eV. As such, the filament drive 150 is electrically biased with the negative terminal 154 at the potential of −70 V for the desired electron energy. Alternatively, the bias potential may range from about 0 V to about −300 V. In addition, the housing 64, including the shield portion 65 and the cover portion 66, is also electrically coupled to the negative terminal 154 via terminal post 82 and is negatively biased with respect to the ion volume 36 at the same bias potential.

In this regard, it is to be understood that all or part of the housing 64 may be considered an electrical element that is in a region proximate to the filaments 46, 48, and thus form at least part of a first portion as described above. The housing 64 or any part of it may be electrically insulated from the filaments and may be electrically biased relative to one or more of the filaments and the enclosure forming the ion volume 36. All or part of the enclosure forming the ion volume 36 may be considered to be a second portion that is proximate to the target location 50. At least one of the filaments may be electrically biased relative to one or more of the housing 64 and the enclosure forming the ion volume 36. Thus, at least one of the filaments may be electrically biased relative to at least one of the first and second portions. Alternatively, other elements having electrically conductive, insulative, or semiconductive properties may be capable of being biased and may be alternatively or additionally substituted for all or part of the housing 64 and the enclosure forming the ion volume 36. These elements form portions of the ion source that are capable of being biased to urge the electrons from the filaments 46, 48 toward the ion volume.

The filament supply 52 further includes a detect circuit 174 of a known type for detecting whether the filament drive 150 is supplying a current through the currently selected filament. In other words, if there is a filament burnout (i.e. open circuit) with one of the filaments 46 and 48, the detect circuit 174 relays this information to the control system 22 at output 54. As such, the control system 22 can actuate the switch 156 to energize the non-burned out filament 46 or 48, and continue operation of the mass spectrometer 10. Also, an operator is notified of the filament burnout condition. The current scan may need to be restarted, but the mass spectrometer 10 is not rendered completely inoperative by a burned-out filament, and can continue operating with a minimum of disruption.

The filament supply 52 further includes an electron lens bias circuit 175 that is controlled by a control signal 176 from the control system 22. The lens bias circuit 175 provides a bias potential to the electron lens 68 of the filament assembly 45 via the support post 94. The electron lens 68 is positively biased with respect to the ion volume 36. In the disclosed embodiment, the electron lens 68 is electrically biased at a potential of +15 V with respect to the ion volume 36. Alternatively, the bias potential may optionally range from 0 V to about +150 V. The electron lens is regularly kept at or above the potential of the ion volume. Since the filament is more negative than the ion volume, the electron lens is usually never at a potential between the ion volume and filament. However, depending on the specific geometries and desired energy for electrons entering the ion volume, the electron lens 68 may be placed at the same potential as the ion volume or at a potential between that of the ion volume and the filaments 46, 48. Even though the bias potentials of the filaments 46 and 48, housing 64, and electron lens 68 have been disclosed with respect to a grounded ion volume 36, the ion volume may alternatively float at a desired potential and the bias potentials of the filaments, housing, and electron lens may be set relative to the potential of the ion volume.

As previously disclosed, in a filament burnout condition the mass spectrometer 10 can continue to operate with the non-burned out filament. The filament burnout may occur during a sample run. The operator does not have to delay the sample run and shut down the mass spectrometer 10 to repair and/or replace the burned out filament. Since the two filaments will typically not have completely identical characteristics, it will usually be necessary to scrap any scan that was in progress and restart that scan, but this can be quickly and efficiently accomplished during the sample run that is already in progress. The operator can thus restart the interrupted scan with the non-burned out filament without delay. As such, the operator can wait to repair and/or replace the filament during a down-time or a scheduled maintenance of the mass spectrometer 10. In the situation where one or both filaments have burned out, the modular configuration of the filament assembly 45 (FIGS. 2 and 3) allows for easy removal and replacement. The filament assembly 45 readily connects to the mass spectrometer 10 via the filament terminal posts 82-84 and electron lens support post 94, the mass spectrometer having not-illustrated electrical connectors that cooperate with the posts 82-84 and 94. The filament assembly 45 may be repaired with new filaments, or replaced with a new filament assembly.

In the disclosed embodiment, the filament 48 is illustrated in FIG. 5 as the active filament and filament 46 as the inactive filament. The filament 46 partially extends through the opening 114 of the cover portion 64 (FIG. 3) by a greater distance than filament 48. As such, filament 46 is closer to the ion volume 36 (FIG. 1) than filament 48. It is contemplated that filament 46 will typically be energized first, because there is no direct obstruction between it and the ion volume. Then, after the filament 46 is burned out, the filament 48 will be energized. When the filament 46 burns out, the central emission section may be missing, and in that case there would be no direct obstruction between the filament 48 and the ion volume. But even when filament 48 is active and filament 46 is still entirely present, it has been observed that a filament drive current required to produce a specified electron emission current from filament 48 is not significantly different from that for a single filament configuration. In addition, the number and stability of characteristic ions of the sample material produced is substantially the same for CI and EI modes of operation when the instrument is operated with both the dual filament configuration and the single filament configuration. The number and stability of the characteristic ions of the sample material produced is a measure or indication of the emitted electrons which reach the ion volume such that it can be seen that two filaments in accordance with the embodiment of the present invention has no significant adverse affect on the results obtained from an instrument.

While not illustrated, a biased electron collector/reflector may be placed generally on line 49 on an opposite side of the enclosure forming the ion volume from the opening 38. An opening in the enclosure may be provided to enable passage of electrons from the ion volume for at least one of collection and reflection in the biased ion collector/reflector. A feedback/control line may connect the collector/reflector to the control system 22 for sending and/or receiving signals to aid in regulating the emission currents/voltages.

Although one selected embodiment has been illustrated and described in detail, it will be understood that it is exemplary, and that a variety of substitutions and alterations are possible without departing from the spirit and scope of the present invention, as defined by the following claims. For example, it is to be understood that more than two filaments can be implemented in place of the two filament configuration shown and described above without departing from the spirit and scope of the invention. That is, three, four, five, or any number of filaments could be placed adjacent to each other to provide redundancy when an active filament burns out. The plurality of filaments may be aligned axially with emission sections aligned on the line of travel of the electrons into the ion volume.

What is claimed is:

1. An apparatus comprising an electron source for selectively providing a first stream of electrons that travels in a direction along an imaginary line to a location remote from the electron source, and for selectively providing a second stream of electrons that travels in the direction along the line to the location, the electron source including:

a first electron emitter for selectively emitting electrons for the first stream; and a second electron emitter positioned in a close fixed relationship to the first electron emitter for selectively emitting electrons for the second stream, wherein the imaginary line is normal to and extends through the central axes of the emission sections of the first electron emitter and the second electron emitter while both emitters are positioned in the direction of the imaginary line; and wherein a distance between the central axes of the emission sections of the first electron emitter and the second electron emitter is less then half the length of either the first electron emitter or the second electron emitter, such that heat transferred from the first electron emitter in an active state to the second electron emitter in an inactive state reduces condensation on the second electron emitter.

2. An apparatus according to claim 1, including structure having an ion volume and an electron opening, the electron opening providing communication between the ion volume and a region external to the structure, the first and second electron emitters being disposed on the same side of the structure, the line extending through the electron opening and the location being within the ion volume.

3. An apparatus according to claim 2, wherein the structure further includes an exit opening providing communication between the ion volume and a region external to the structure; and including a mass analyzer that receives ions from the ion volume via the exit opening.

4. An apparatus according to claim 1, wherein the first electron emitter includes a first filament and the second electron emitter includes a second filament.

5. An apparatus according to claim 4, wherein the first and second filaments are each one of a hairpin, a ribbon, and a coil.

6. An apparatus according to claim 5, wherein the first and second filaments are hairpins.

7. An apparatus according to claim 4, wherein the first and second filaments are physically different.

8. An apparatus according to claim 7, wherein the first filament is made of a first material and the second filament is made of a second material, the first and second materials being different.

9. An apparatus according to claim 4, wherein the electron source further includes structure that facilitates a current flow through the first filament and facilitates a current flow through the second filament.

10. An apparatus according to claim 9, including circuitry that is electrically coupled to the structure and that produces a current, the circuitry including a switch having two states in which it routes the current though the first and second filaments, respectively.

11. An apparatus according to claim 1, wherein the first and second filaments have similar electron emission characteristics when energized with a current.

12. An apparatus according to claim 1, wherein the emission section of the first filament is elongate and has a first center line and the emission section of the second filament is elongate and has a second center line, the first center line and the imaginary line lying in a first imaginary plane and the second center line and the imaginary line lying in a second imaginary plane, the first and second imaginary planes being at an angle to each other.

13. An apparatus according to claim 12, wherein the angle is one of approximately 60° and approximately 90°.

14. An apparatus according to claim 1, wherein the electron source further includes a first portion that is electrically biased relative to at least one of the first and second filaments, the first portion being disposed in a region proximate to the first and second filaments.

15. An apparatus according to claim 14, wherein the first portion includes a housing having an opening, the housing partially enclosing each of the first and second filaments such that the first filament extends outwardly through the opening by a first distance and the second filament extends outwardly through the opening by a second distance, the first distance being greater than the second distance, and the emission section of each filament being disposed outside the housing.

16. An apparatus according to claim 1, wherein the electron source further includes a second portion that is electrically biased relative to at least one of the first and second filaments, the second portion being disposed in a region proximate to the location.

17. An apparatus according to claim 1, wherein the electron source further includes a third portion comprising an electron lens, the third portion being electrically biased relative to at least one of the first and second filaments, the third portion being disposed in a region proximate to the first and second filaments.

18. An apparatus according to claim 1, further comprising a housing having an opening, the housing partially enclosing each of the first and second filaments such that the first filament extends outwardly through the opening by a first distance and the second filament extends outwardly through the opening by a second distance, the first distance being greater than the second distance, and the emission section of each filament being disposed outside the housing.

19. An apparatus according to claim 1, wherein the first filament is spaced from the location by a first distance and the second filament is spaced from the location by a second distance, the second distance being greater than the first distance.

20. A method for operating an apparatus having an electron source that includes first and second electron emitters that can each selectively emit electrons comprising:

selectively producing a first stream of electrons that travels from the first electron emitter in a direction along an imaginary line to a location remote from the electron source; and selectively producing a second stream of electrons that travels from the second electron emitter positioned in a close fixed relationship to the first electron emitter in the direction along the line to the location, wherein the imaginary line is normal to and extends through the central axes of the emission sections of the first electron emitter and the second electron emitter while both emitters are positioned in the direction of the imaginary line; and wherein a distance between the central axes of the emission sections of the first electron emitter and the second electron emitter is less then half the length of either the first electron emitter or the second electron emitter, such that heat transferred from the first electron emitter in an active state to the second electron emitter in an inactive state reduces condensation on the second electron emitter.

21. A method according to claim 20, wherein the first and second electron emitters are in a region of a first portion of the ion source;

wherein the apparatus includes a second portion proximate to the location; and wherein the selectively producing the first stream of electrons includes energizing the first electron emitter while de-energizing the second electron emitter, and electrically biasing the first electron emitter relative to the second portion so that emitted electrons are encouraged to travel to the location.

22. A method according to claim 20, wherein the first and second electron emitters are in a region of a first portion of the ion source;

wherein the apparatus includes a second portion proximate to the location; and wherein the selectively producing the second stream of electrons includes energizing the second electron emitter while de-energizing the first electron emitter, and electrically biasing the second electron emitter relative to the second portion so that emitted electrons are encouraged to travel to the location.

23. A method according to claim 20, wherein the electron source further includes a first portion, the first portion being disposed in the region of the first and second electron emitters;

wherein the electron source further includes a second portion proximate to the location; and including electrically biasing at least one of the first and second electron emitters relative to at least one of the first portion and the second portion so that emitted electrons are encouraged to travel to the location.

24. A method according to claim 20, wherein the apparatus includes a first portion in a region of the first and second electron emitters and a second portion proximate to the location; and wherein the selectively producing one of the first stream of electrons and second stream of electrons includes electrically biasing the second portion relative to one of the first electron emitter and second electron emitter, respectively, so that emitted electrons are encouraged to travel to the location.

* * * * *